US006969437B1

(12) United States Patent
Bowers

(10) Patent No.: US 6,969,437 B1
(45) Date of Patent: Nov. 29, 2005

(54) YARN WITH HEAT-ACTIVATED BINDER MATERIAL AND PROCESS OF MAKING

(75) Inventor: Charles Edward Bowers, Hopewell, VA (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/143,583

(22) Filed: Aug. 31, 1998

Related U.S. Application Data

(63) Continuation-in-part of application No. 08/933,822, filed on Sep. 19, 1997, now Pat. No. 6,682,618, which is a continuation-in-part of application No. 08/792, 819, filed on Jan. 30, 1997, now abandoned.

(51) Int. Cl.[7] ..... D02G 3/40

(52) U.S. Cl. ..... 156/72; 57/238; 57/244; 57/251; 57/256; 428/377; 428/395

(58) Field of Search ..... 57/238, 244, 251, 57/252, 328, 256; 156/72, 148; 428/377, 428/395

(56) References Cited

U.S. PATENT DOCUMENTS

| | | | | | |
|---|---|---|---|---|---|
| 2,252,999 | A | | 8/1941 | Wallach | 57/164 |
| 2,880,112 | A | | 3/1959 | Drelich | 428/338 |
| 3,494,819 | A | | 2/1970 | McAlister | 428/253 |
| 3,494,822 | A | | 2/1970 | Weldon | 161/172 |
| 3,828,542 | A | | 8/1974 | Boutonnet et al. | 57/247 |
| 3,877,214 | A | | 4/1975 | Van der Werf | 57/164 |
| 3,978,267 | A | | 8/1976 | Selwood | 428/374 |
| 3,978,647 | A | | 9/1976 | Kosaka et al. | 57/251 |
| 3,987,615 | A | * | 10/1976 | Hill, Jr. | |
| 4,231,169 | A | | 11/1980 | Toyama et al. | 428/408 |
| 4,307,566 | A | | 12/1981 | Hurata et al. | 428/395 |
| 4,355,592 | A | | 10/1982 | Tajiri et al. | 112/410 |
| 4,412,877 | A | * | 11/1983 | Vosburgh | 428/95 |
| 4,424,250 | A | | 1/1984 | Adams et al. | 428/288 |
| 4,484,433 | A | * | 11/1984 | Stahlecker et al. | 57/15 |
| 4,495,758 | A | | 1/1985 | Stahlecker et al. | 57/19 |
| 4,541,231 | A | * | 9/1985 | Graham, Jr. et al. | |
| 4,552,603 | A | | 11/1985 | Harris, Jr. et al. | 428/373 |
| 4,601,949 | A | | 7/1986 | Bach et al. | 428/373 |
| 4,644,741 | A | * | 2/1987 | Gradinger et al. | |
| 4,668,552 | A | | 5/1987 | Scott | 428/92 |
| 4,668,553 | A | | 5/1987 | Scott | 428/92 |
| 4,690,860 | A | | 9/1987 | Radvan et al. | 428/290 |
| 4,807,430 | A | * | 2/1989 | Palmer | 57/18 |
| 4,851,501 | A | | 7/1989 | Lubowitz et al. | 428/290 |
| 4,861,649 | A | | 8/1989 | Browne | 428/911 |
| 4,871,604 | A | | 10/1989 | Hackler | 428/96 |
| 4,916,000 | A | | 4/1990 | Li et al. | 428/911 |
| 4,943,472 | A | | 7/1990 | Dyksterhouse et al. | 428/288 |
| 5,175,038 | A | * | 12/1992 | Tung et al. | 428/369 |
| 5,478,624 | A | * | 12/1995 | Lofquist | |
| 5,567,256 | A | * | 10/1996 | Queen et al. | 156/72 |
| 5,611,819 | A | * | 3/1997 | Nomura et al. | 8/529 |

FOREIGN PATENT DOCUMENTS

| | | | | |
|---|---|---|---|---|
| CH | 220994 | | 8/1942 | |
| DE | 240 918 | | 11/1986 | |
| EP | 0444637 | | 2/1991 | |
| EP | 0466618 | | 7/1991 | |
| FR | 2124919 | | 9/1972 | |
| GB | 1168404 | | 10/1969 | |
| GB | 1208293 | | 10/1970 | |
| GB | 2205116 | | 11/1988 | |
| GB | 2205116 | A * | 11/1988 | |
| JP | 52-18835 | | 5/1977 | D03D 27/00 |
| JP | 60-224831 | | 11/1985 | D02G 3/44 |
| JP | 61-100222 | | 5/1986 | A47L 13/20 |
| JP | 61-100223 | | 5/1986 | A47L 13/20 |
| JP | 61-245322 | | 10/1986 | D02G 1/02 |
| JP | 62-117869 | | 5/1987 | |
| JP | 09119034 | | 5/1997 | |
| WO | 88/03969 | * | 6/1988 | |
| WO | WO 88/03969 | | 6/1988 | |
| WO | WO 94/20657 | | 9/1994 | |
| WO | WO 95/30040 | | 11/1995 | |
| WO | WO 9914408 | | 3/1999 | |
| ZA | 72-0545 | | 1/1972 | |

* cited by examiner

*Primary Examiner*—Sam Chuan Yao
(74) *Attorney, Agent, or Firm*—Virginia Szigeti

(57) ABSTRACT

Yarn suitable for tufting comprises a base fiber ring spun or wrap spun with a second fiber at least partially comprising a heat-activated adhesive material such that the yarn includes from 0.1 to 12, preferably 0.25 to 10, weight percent adhesive material having a melting point within the range of 105° to 190° C., more preferably 165° to 190° C. A preferred base fiber is a synthetic staple fiber bundle. A preferred wrapping or insert fiber comprises copolyamide material, including ternary copolyamides of the 6/66/12 type. When the yarn is twist set by conventional processes and then tufted into carpet, the resulting carpet displays enhanced wear and appearance properties.

10 Claims, No Drawings

YARN WITH HEAT-ACTIVATED BINDER MATERIAL AND PROCESS OF MAKING

CROSS REFERENCE TO RELATED APPLICATIONS

This is a continuation-in-part of U.S. Ser. No. 08/933,822 filed Sep. 19, 1997, now U.S. Pat. No. 6,682,618, which is a continuation-in-part application of U.S. Ser. No. 08/792,819 filed Jan. 30, 1997 now abandoned.

FIELD OF THE INVENTION

The invention relates to yarn suitable for tufting, especially to form carpet face fiber, and for other applications. The yarn comprises a blend of fibers including a first, preferably synthetic, base fiber, ring spun or wrap spun with a second fiber that at least partially comprises a heat-activated adhesive material having a melting point substantially below that of the base fiber. In a process for production of a yarn suitable for tufting, particularly for use in a carpet, exposure of the yarn to usual process conditions for twist setting the yarn causes the heat-activated adhesive material in the second fiber, inserting or wrapping fiber, as appropriate, to melt substantially completely and flow to points of intersecting filaments to create a bond upon subsequent cooling, thus altering properties and performance of the resulting product.

DESCRIPTION OF RELATED ART

It has been known to blend non-adhesive fibers with potentially adhesive fibers to form a yarn or other textile structure or article, then to activate the potentially adhesive fibers to bond them to contacting fibers, thus modifying end-use properties of the yarn. U.S. Pat. No. 2,252,999 provides a process wherein a yarn comprising an admixture of non-adhesive and potentially adhesive fibers is formed, the potentially adhesive fiber is activated, and the fibers are compacted while in an adhesive condition so that they adhere to each other at points of contact. U.S. Pat. No. 3,877,214 discloses a twist-free yarn comprising a polyamide fiber melting under a relatively low temperature as a bonding component. U.S. Pat. No. 3,494,819 discloses a blend of fusible and non-fusible polyethylene terephthalate fibers incorporated into fabric, wherein the finished fabric is heated to fusion temperatures to provide improved pill resistance. U.S. Pat. No. 3,978,267 discloses a substantially twistless compact yarn comprising a portion of potentially adhesive fiber, which has been activated to bond contacting fibers.

Cut-pile carpet is customarily produced from staple or bulked continuous filament (BCF) yarns. For example, staple fiber is conventionally carded, pinned, and ring spun or wrap spun into a singles yarn, which typically is twisted and plied with similar yarn(s) to form a 2-ply or 3-ply yarn construction. The yarn is twist set by one of the commercially available twist setting processes such as the Suessen or Superba processes.

In a typical twist setting process the yarn is passed through a heated chamber, while in a relaxed condition. The temperature of this process step is crucial to the proper twist setting of the base fiber, to obtain desired properties of the final carpet product. For nylon-6 base fiber, the conditions for this step are typically 190–200° C. with a residence time of about 60 seconds for the Suessen process and about 125–140° C. with a residence time of about 30 to 60 seconds for the Superba process. The Superba process utilizes saturated steam and thus the yarn is subjected to a much higher level of humidity than in the Suessen process.

BCF yarn produced according to one of the known methods can similarly be twisted, entangled and/or cabled to form a yarn construction for twist setting. Twist setting conditions for BCF or staple yarns can be as set forth above or can occur in an autoclave at 132° C. in saturated steam with a residence time of about 40 to 60 minutes.

Multiple ends of the twist set yarns, either staple or BCF, are tufted into pile carpet and conventionally dyed and finished to obtain the desired carpet product.

It is known to wrap fiber, both staple and BCF, with a binder strand to physically bind the exterior of the fiber to permit downstream processing. See, e.g., U.S. Pat. Nos. 4,495,758 and 4,668,553. Neither of these patents, however, uses or suggests the use of a binder strand or fiber that contains heat-activated adhesive material to adhere fibers (staple and/or continuous filament) at points of contact.

SUMMARY OF THE INVENTION

Yarn, preferably synthetic, comprises at least one bundle of fiber, the fiber being ring spun or wrap spun with a second fiber (either an insert fiber in the case of ring spun or a wrapping fiber in the case of wrap spun) comprising a heat-activated binder material, preferably a fiber, having a melting point range of about 105 to 190° C., preferably 165 to 190° C., under ambient conditions, such that the yarn comprises a total of 0.1 to 12, preferably 0.25 to 10, more preferably 0.5 to 8, weight percent binder material. The preferred first fiber bundle comprises staple fibers, preferably in the form of a sliver. Alternatively the first bundle of fibers may be a bundle of continuous filaments (an end). The preferred second, binder fiber is a copolyamide, more preferably a copolyamide of the nylon 6/nylon 6,6 type. The preferred first bundle of fibers is nylon 6.

The present invention is also a process of producing a yarn suitable for tufting, the process comprising the steps of:

a. forming a bundle of fiber, preferably by spinning staple fiber;
b. ring spinning or wrap spinning the bundle of fiber with a second fiber comprising a heat-activated binder material having a melting point range of about 105 to 190° C., preferably 165 to 190° C., under ambient conditions to form a yarn;
c. twisting two or more of the yarns to form a plied yarn comprising 0.1 to 12, preferably 0.25 to 10, more preferably 0.5 to 8, weight percent of the binder material;
d. heating the plied yarn, preferably during twist setting, sufficiently to melt the binder material; followed by
e. cooling the plied yarn, preferably during twist setting, to solidify the binder material.

With ring spinning, the insert fiber is preferably inserted before the front delivery roll into a continuous bundle of base fibers, preferably staple fibers in a sliver; the insert fiber can also be added after the front delivery roll but before or at the pigtail guide during insertion of twist that forms the ring spun yarn.

The preferred binder material is in the form of fiber(s) and can consist of 100% heat-activated adhesive fibers or consist of a blend of heat-activated adhesive fibers and non-adhesive fibers. Binder fibers as such can be staple or continuous filament.

This invention also relates to yarn made in accordance with the aforesaid process.

In an alternate embodiment the present invention is a process for producing a plied yarn suitable for tufting, comprising the steps of:

a. forming a bundle of fiber, preferably by spinning;
b. ring spinning the bundle of fiber into a ring spun yarn, preferably by inserting a second fiber comprising a heat-activated binder material having a melting point range of about 105 to 190° C., more preferably from about 165 to 190° C., under ambient conditions, into the bundle of fiber;
c. twisting at least two ring spun yarns with at least one second fiber to form a plied yarn, the second fiber(s) comprising a heat-activated binder material having a melting point of about 105 to 190° C., more preferably about 165 to 190° C., under ambient conditions, the plied yarn comprising 0.1 to 12, preferably 0.25 to 10, more preferably 0.5 to 8, weight percent of the binder material;
d. heating the plied yarn sufficiently to melt the binder material, preferably by twist setting; followed by
e. cooling the plied yarn to solidify the binder material.

The preferred twisting is ply twisting wherein the ring spun yarns are wound with the second fiber(s) to form an assembly wound package to provide the feed yarns for the ply-twisting step. This invention also relates to yarn made in accordance with the aforesaid process.

When the yarn is twisted, plied and twist set by conventional processes, for example 190–200° C. Suessen twist setting with a residence time of about 60 seconds, and the treated yarn tufted into cut-pile carpet, followed by conventional dyeing and finishing, the resulting carpet displays enhanced carpet tuft appearance, improved resilience, and reduced change of appearance with use.

DESCRIPTION OF THE PREFERRED EMBODIMENT

By "fiber" is meant monofilament or multifilament, either continuous in length or cut in staple lengths. A "bundle" of fiber is defined as a spun (staple) fiber or a group of continuous multifilaments or a combination of the two. By "yarn" is meant a combination of two or more fibers.

Applicant has discovered that by incorporation of a minor portion of heat-activated binder material, preferably fiber, having substantially lower melting point than the base fiber, into a carpet yarn construction, the standard heat conditions for twist setting the carpet yarn will cause the binder fiber to melt, substantially losing its identity as a fiber. It will flow to intersecting points of base fiber and upon subsequent cooling will encapsulate and bind fibers and yarn together, thereby retaining the twist in the twist set yarn for subsequent tufting to form cut-pile carpets. Carpets made with the yarn of this invention have improved surface aesthetics, hand, durability and wear performance. By careful selection of the binder fiber, desired improvement is built into the yarn with no additional process steps required by the yarn spinner, the carpet manufacturer, or in dyeing and finishing.

The base fiber is selected from known synthetic fibers suitable for carpet use, such as polyamides, e.g., nylon-6 and nylon-6,6; polyesters; and polyolefins; as well as from natural fibers suitable for carpet use, such as cotton and wool.

The binder material (fiber) is selected to provide good adhesion to the base fiber. It is important that the melting point of the binder fiber be in the range of about 105 to 190° C., preferably about 165 to 190° C., under ambient humidity conditions. This range ensures that the binder fiber will melt during the conventional twist setting process, yet will provide adequate adhesive properties during any subsequent dyeing steps and final use. A saturated steam environment, such as in an autoclave, reduces the fiber melting point of polyamide binder fibers dramatically.

A preferred class of binder fiber for use with polyamide base fibers is copolyamides within the specified melting point ranges. Suitable copolyamides of the 6/66/12 type and a process for their production are disclosed in UK Patent 1,168,404. A melt bonding copolyamide adhesive fiber is commercially available from EMS as GRILON® type K 140 (melting range 130–140° C.); also available is type K 115 (melting range 110–117° C.), a copolyamide of the 6/66 type as described in U.S. Pat. No. 5,478,624.

The binder fiber can be blended with, wrapped around, or inserted into base fibers, and the resulting fiber blend can then be processed in known ways. It is important to ensure a thorough blending when the binder fiber is blended with base staple fiber to avoid potential clumps in the finished carpet. The final tufting yarn should contain 0.1–12 weight percent binder fiber, preferably 0.25 to 10 weight percent, and more preferably 0.5 to 8 weight percent. Higher amounts cause undesirable harshness of hand due to the conditions of the twist setting process causing the binder fiber to melt substantially completely. Ring spun or wrap spun yarns prepared from such a blend and subjected to thermal activation can provide strength properties approaching that of bulked continuous filament (BCF) yarns. Properties of BCF yarns can also be enhanced.

By selection of the thermally activated binder fiber within the weight percent ranges and melting point ranges specified it is possible to modify end-use properties of the finished carpet to improve wear resistance, resilience, reduced change of appearance over time and with use, and to increase hand, luster and apparent value. Denier per filament, cut length, fiber cross-section, crimp type and frequency, surface finish, melt viscosity, softening point, melting point, dye affinity, and other properties must be balanced to achieve ideal properties in the final product. Preferred base fibers are characterized by a denier per filament (dpf) ranging from about 6 to 22 and in the instance of spun fibers, a staple length ranging from about 7.6 to 21 cm (3.0 to 8.5 inches), more preferably from about 15 to 20 cm (6.0 to 8.0 inches).

A proper selection of the binder fiber must be made to obtain the desired, or optimum results from the finished carpet product. This will depend on numerous factors including the denier, length, crimp, finish, and other properties of the base fiber product. Preferred binder fibers are characterized by a dpf ranging from about 6 to 22, more preferably from about 6 to 17, and in the instance of spun fibers, a staple length ranging from about 7.6 to 21 cm (3.0 to 8.5 inches), more preferably from about 7.6 to 13 cm (3.0 to 5.0 inches).

Carpets also may be produced from yarns made by introducing a binder fiber as the wrapper fiber that is placed uniformly around a continuous bundle of base staple fibers at wrap (hollow spindle) spinning to produce a wrap spun yarn (see Example 3 below). The binder fiber can consist entirely of heat-activated adhesive fibers or can consist of a blend of heat activated adhesive fibers and non-adhesive fibers. Binder fibers as such can be either continuous filament or spun staple produced by conventional manufacturing methods.

When the resulting wrap spun yarn is twisted into a plied yarn, twist set by conventional process, and the treated yarn tufted into cut-pile carpet followed by conventional dyeing and finishing, the carpet displays enhanced carpet tuft appearance, more resilience, and better wear resistance than similar carpets not containing the binder yarn. These carpet improvements can be further enhanced by the continuous bundle of base staple fibers being a blend, with a low weight percent of heat-activated adhesive fibers and a high weight percent of non-adhesive fibers, around which the binder fiber, described above, is wrapped.

Ring spun yarns suitable for tufting into carpets may be produced in accordance with this invention by introducing a binder fiber to the sliver before the front delivery roll, or after the front delivery roll (before or at the pigtail guide) during insertion of twist that forms the ring spun yarn. On a woolen ring spinning frame, the binder fiber is introduced to the roping before the false twist tube, or after the front delivery roll (before or at the pigtail guide) during insertion of twist that forms a ring spun woolen yarn. The binder fiber can consist entirely of heat-activated adhesive fibers or can consist of a blend of heat-activated adhesive fibers and non-adhesive fibers. Binder fibers as such can be either continuous filament or multifilament or spun staple produced by conventional manufacturing methods. A ring spun yarn in accordance with this invention (see Example 4 below) has greater strength due to the added strength of the inserted yarn in the total spun yarn structure, which results in improved operating performance at spinning by reducing single end breakouts.

The resulting ring spun yarn when later twisted into a plied yarn and twist set by conventional processes results in a treated yarn with altered, unique performance properties. The unique properties are produced by the heat activated adhesive fibers in the inserted binder fiber being combined with the continuous bundle of non-adhesive base staple fibers during the ring spinning process, melting during conventional twist setting processes, and then solidifying when emerging from the elevated temperature forming a durable cross bonding with the non-adhesive base staple fibers within the individual ends of the plied yarn and between the individual ends of the plied yarn.

The treated plied twist set yarn has a more resilient, stiffer hand, significantly improved ply twist retention, and a less hairy surface. When tufted into cut-pile carpet, followed by conventional dyeing and finishing, the hand of the pile is significantly firmer, the individual tufts are tighter and more defined, and the pile surface is cleaner with less hairiness. These carpet improvements can be further enhanced by the continuous bundle of base staple fibers being a blend with a low weight percent of heat-activated adhesive fibers and a high weight percent of non-adhesive fibers in which the binder yarn is inserted as described above.

Carpets also may be produced by introducing a binder fiber to the base yarn at the winding process before ply twisting. The binder fiber is wound parallel with one or more ring spun singles yarns or continuous filament yarns onto the same take-up package (assembly wound package). See Example 5 below.

When the resulting parallel wound package is twisted into a plied yarn, twist set by conventional processes, and the treated yarn tufted into cut-pile carpet followed by conventional dyeing and finishing, the resulting carpet displays a significantly firmer pile hand, tighter and more defined individual tufts, a cleaner pile surface with less hairiness, and better wear resistance than similar carpets not containing the binder yarn. These carpet improvements can be further enhanced by the base yarn being a blend with a low weight percent of heat-activated adhesive fibers and a high weight percent of non-adhesive fibers which the binder yarn is parallel wound beside as described above.

With the utilization of this invention, twist setting conditions normally used are sufficient to activate the binder fiber, to create bind points which strengthen the final product, thereby imparting other characteristics which are desirable. For the Suessen process, under relatively low humidity conditions, the twisted yarn is subjected to a temperature of 190–205° C. for a residence time of 50–60 seconds. In the Suessen process motion of the fiber while in the relaxed state, caused by vibration or air currents, sufficiently motivates the molten binder fiber to flow to the intersecting "touch points" of the base fiber, as a function of the melt flow properties of the binder fiber and surface characteristics. As the fiber emerges from the elevated temperature condition, the binder solidifies and encapsulates or bonds two or more base fibers together at intersecting points in a durable bond. Subsequent processing (including dyeing, finishing, and back coating) with commercial processing methods does not soften the bond points sufficiently to weaken them, but rather strengthens the bond points. The resulting carpet can be of many forms, but a typical style would be cut-pile carpet with about 40 ounces per square yard (oz/yd$^2$) of face yarn including the binder, with an attached backing. Carpet construction would be typically about 0.318 to 0.397 cm (0.125 to 0.156 inch) gauge, about 1.75 to 1.91 cm (0.688 to 0.750 inch) pile height, and the carpet would be dyed, dried, back coated, and sheared using normal processing techniques. The yarn of the invention would also provide unique and important property advantages in the production of loop-pile carpet constructions from spun staple yarn.

EXAMPLE 1

Comparative

A blend of staple fiber was produced with 3 weight percent binder fiber, 7.5 cm (3.0 inches) in length (GRILON® Type K 140 copolyamide fiber having a milt point range of 130 to 140° C., 10 dpf), and 97 weight percent base staple fiber, 20 cm (8.0 inches) in length (AlliedSignal Inc. Type 521 nylon-6 fiber having a melt point range of 215–225° C., 17 dpf).

The blended fiber was carded, pinned, and ring spun into a singles yarn by conventional processing methods. The yarn, a 3.0/1 cotton count yarn containing 4.7 "Z" twists per inch (tpi), was plied with a similar yarn to produce a 2-ply 3.0/2 cotton count 4.7 "Z"×4.0 "S" yarn. The 2-ply yarn was twist set by a conventional Suessen twist setting process. The yarn was passed through a heated chamber at about 195° C. while in a relaxed condition, with a residence time of about 60 seconds.

Multiple ends of this yarn were tufted into cut pile carpet and conventionally dyed and finished. The resulting carpet was compared to a control carpet prepared in the same manner from 100 percent base staple fiber. The carpet containing the binder staple fiber blend displayed enhanced carpet tuft appearance, more resilience, and better wear resistance.

EXAMPLE 2

Carpets also may be produced from bulked continuous filament (BCF) yarns, and carpets thus made can be improved in surface, aesthetics, hand, or in durability and wear by using this invention. In the following example the carpet manufacturer simply uses normal processing techniques to obtain the desired effect.

Filament nylon yarn is produced according to various conventional fiber producer manufacturing methods. These methods are not particularly related to the invention, except that another, smaller, filament yarn will accompany a base yarn throughout subsequent process steps. Often the combination will result in a 2-ply, 3-ply, or other form needed for the carpet style.

In this example, a 70 denier 14 filament binder fiber is combined with an 1185 denier 70 filament fiber in the creel of the direct cabler to produce a yarn with 3.5 "S" tpi in each of the singles and 3.5 "Z" tpi in the resultant 2-ply twisted yarn when combined with another end of 1185 denier 70 filament fiber in the pot (1185×2 ply). The binder fiber, a copolyamide having a melt point range of 105 to 180° C., results in 2.8 weight percent binder material in the combination yarn. This amount can be doubled by using two binder fibers, or varied by providing other denier products to the system.

When the product is subjected to conventional twist setting, the binder is activated producing a final product with the desirable characteristics of enhanced carpet tuft appearance, more resilience, and better wear resistance than similar carpets not containing the binder. The twist setting conditions for this are typically 132° C. (270° F.), in saturated steam, with a residence time of about 30–50 seconds for the Superba twist set process or 40–60 minutes for the autoclave twist set process. As the fiber emerges from the elevated temperature condition, the binder solidifies and encapsulates or bonds two or more base yarns together in a permanent or durable bond.

Multiple ends of these yarns are tufted into cut pile carpet and conventionally dyed and finished to obtain the improved product.

EXAMPLE 3

In this example, the continuous bundle (sliver) of base staple fibers is 17 dpf, 20 cm (8.0 inches) long, AlliedSignal T317 nylon-6 staple fibers (melt point range of 215 to 225° C.), wrapped with a 30 denier 12 filament binder fiber, 7.6 cm (3.0 inches) long, at wrap spinning to produce a 3.35/1 cotton count yarn containing 5.2 "Z" wraps per inch (wpi). This singles yarn is then plied with another singles end of the same yarn to produce 3.35/2 cotton count 5.2 "Z" wpi×5.4 "S" tpi final yarn. This final yarn contains a sufficient amount of copolyamide (nylon 6 and 6,6) binder fiber (30 denier 12 filament fiber, melt point range of 105 to 180° C., commercially available from AlliedSignal Inc. as SCBF-1) wrapped around each end of the 2 plies to result in 2.0 weight percent binder material.

This 3.35/2 cotton count yarn was twist set by a conventional stuffer box Suessen twist setting process. The yarn was passed through a heated chamber at 190° C., while in a relaxed condition, with a residence time of 60 seconds. Multiple ends of this yarn were tufted into cut-pile carpet and conventionally dyed and finished to obtain the improved product. The resulting carpet was compared to a control carpet prepared in the same manner from 100 percent AlliedSignal T317 nylon-6 base staple fibers. The carpet containing the 2.0 percent binder material displayed tighter and more defined individual pile tufts, a more resilient, stiffer hand, enhanced carpet surface appearance with significantly less hairiness, and better wear resistance.

EXAMPLE 4

In this example, a 30 denier 12 filament binder fiber (SCBFj-1) is inserted before the front delivery roll into the continuous bundle of base staple fibers (sliver) being drafted at ring spinning. The sliver (100% 17 denier per filament AlliedSignal T317 nylon-6 staple fibers) is spun into a 3.0/1 cotton count yarn containing 4.8 "Z" tpi. This singles yarn is then plied with another, identical singles yarn to produce 3.0/2 cotton count 4.8 "Z" tpi×4.1 "S" tpi final yarn. This final yarn contains a binder yarn in each end of the 2 plies. The remainder of the 3.0/2 cotton count yarn is AlliedSignal T317 nylon-6 staple fibers, which results in a blend of about 1.7 percent binder. This ratio can be increased by inserting a larger denier binder yarn at the front delivery roll, or by a low weight percent of heat activated adhesive fibers and a high weight percent of non-adhesive AlliedSignal T317 nylon-6 staple fibers blend being in the continuous bundle (sliver) of base staple fibers, before ring spinning, in which the 30 denier 12 filament binder yarn is inserted at the front delivery roll of ring spinning.

This final 3.0/2 cotton count yarn was twist set by a conventional Suessen twist setting process. The yarn was passed through a heated chamber at 190° C., while in a relaxed condition, with a residence time of 60 seconds. Multiple ends of this yarn were tufted into cut-pile carpet and conventionally dyed and finished to obtain the improved product.

The resulting carpet was compared to a control carpet prepared in the same manner from 100 percent non-adhesive AlliedSignal T317 nylon-6 base staple fibers. The carpet containing the 1.7 percent inserted binder yarn displayed more defined individual pile tufts, a more resilient, stiffer hand, and a cleaner, enhanced carpet surface appearance which is more like a BCF cut pile carpet.

EXAMPLE 5

In this example, a 60 denier 24 filament binder yarn (SCBF-1) is parallel wound with two ring spun singles yarns onto a ten inch traverse take-up package at the winding process. The ring spun singles yarn is entirely 17 dpf AlliedSignal T317 nylon-6 staple fibers, which is spun into a 3.0/1 cotton count yarn containing 4.8 "Z" tpi. The parallel wound package assembly with one end of 60 denier 24 filament yarn and two ends of T317 nylon-6 staple fibers 3.0/1 cotton count ring spun yarn is then 2-for-1 twisted and plied to produce a 3.0/2, 4.8 "Z" tpi×4.1 "S" tpi final yarn. This final yarn contains a binder yarn, which is the 60 denier 24 filament yarn that was parallel wound with the two ends of 3.0/1 cotton count ring spun yarn at the winding process. The amount of binder material present in the plied yarn is about 1.7 weight percent. This ratio can be increased by using a larger denier binder yarn at winding, or by a low weight percent of heat activated adhesive fibers and a high weight percent of non-adhesive staple fibers in the 3.0/1 ring spun base yarn before winding.

This final 3.0/2 cotton count yarn was twist set by a conventional Suessen twist setting process. The yarn was passed through a heated chamber at 190° C., while in a relaxed condition, with a residence time of 60 seconds. Multiple ends of this yarn were tufted into cut-pile carpet and conventionally dyed and finished to obtain the improved product.

The resulting carpet was compared to a control carpet prepared in the same manner from 100% AlliedSignal T317 nylon-6 base staple fibers. The carpet containing 1.7 percent parallel wound binder material displayed tighter and more defined individual pile tufts, a more resilient, stiffer hand, a cleaner, enhanced carpet surface appearance, and better wear resistance.

On a ring ply twisting process, similar carpet results, as described above, can be achieved by combining the same one end of 60 denier 24 filament binder yarn and the same two ends of T317 nylon-6 staple fibers 3.0/1, 4.8 "Z" tpi cotton count ring spun yarn in the creel of the ring ply twister to produce a twisted and plied 3.0/2 cotton count 4.8 "Z" tpi×4.1 "S" tpi final yarn.

What is claimed is:

1. A process for producing a yarn suitable for tufting, said process comprising the steps of:

a. forming a bundle consisting essentially of a first base fiber, said first base fiber being selected from the group consisting of polyamides, polyesters, polyolefines, cotton and wool;

b. ring spinning or wrap spinning the bundle of fiber with a second fiber; said second fiber being twisted or wrapped uniformly around the bundle of fiber and consisting essentially of a blend of a second base fiber and a heat-activated binder material having a melting point lower than that of said bundle of fiber to form a yarn, said yarn comprising 0.1 to 12 weight percent of the binder material; the heat-activated binder material having a melting point range substantially below that of the base fiber, wherein said base activated binder material has a melting point range of 105° to 190° C. under ambient conditions;

c. twisting two or more of the yarns to form a plied yarn comprising 0.1 to 12 weight percent of the binder material;

d. heating the piled yarn sufficiently to melt the binder material and causing the binder material to flow to intersecting points with the first base fiber; followed by e. cooling the plied yarn to solidify the binder material to thereby encapsulates and bind the first base fiber and retain the twist in the plied yarn.

2. The process of claim 1 wherein said heating step occurs during twist setting of the plied yarn.

3. The process of claim 1, wherein the bundle of fiber is formed by spinning staple fiber.

4. The process of claim 1 wherein the base fiber is nylon-6 having melt point range of 215 to 225° C.

5. The process of claim 1 wherein the bundle consisting essentially of a first base fiber is selected from the group consisting of a sliver and a bundle of continuous filaments.

6. The process of claim 1 wherein said first base fiber is a polyamide selected from the group consisting of nylon-6 and nylon-6,6.

7. The process of claim 1 wherein said second fiber comprises a copolyamide.

8. The process of claim 1 wherein said second fiber comprises a copolyamide of nylon 6/nylon 6,6 or nylon 6/nylon 6,6/nylon 12.

9. The process of claim 1 wherein said first base fiber is a polyamide and said second fiber comprises a copolyamide.

10. The process of claim 1 wherein said first base fiber is a polyamide selected from the group consisting of nylon 6/nylon 6,6 or nylon 6/nylon 6,6/nylon 12.

* * * * *